US006435901B1

(12) United States Patent
Burack et al.

(10) Patent No.: US 6,435,901 B1
(45) Date of Patent: Aug. 20, 2002

(54) METHOD FOR PROTECTING AND REWORKING CONNECTOR BLOCK WIRING

(75) Inventors: John Joseph Burack, Toms River; Bassel Daoud, Parsippany, both of NJ (US); Thomas Michael Hamilton, Council Bluffs, IA (US); Jason A. Kay, Morristown; David S. Kerr, Morris Plains, both of NJ (US); Ivan Pawlenko, Holland; Larry Samson, Langhorne, both of PA (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/710,594

(22) Filed: Nov. 10, 2000

(51) Int. Cl.[7] ..... H01R 13/52

(52) U.S. Cl. ..... 439/519; 439/936

(58) Field of Search ..... 439/709, 801, 439/888, 936

(56) References Cited

U.S. PATENT DOCUMENTS 5,360,350 A * 11/1994 Koblitz et al. ..... 439/276
6,155,891 A * 12/2000 Daoud ..... 439/888

* cited by examiner

*Primary Examiner*—Khiem Nguyen

(57) ABSTRACT

In accordance with the invention, rather than embedding them collectively in potting compound, wire to pin connections on a connector block are separately coated with protective gel for resisting corrosion. The coating can be effected with high volume gel dispensing equipment in shop environments and by manual gel dispensing in the field, providing significant advantages rework and repair in the field.

10 Claims, 2 Drawing Sheets

METHOD FOR PROTECTING AND REWORKING CONNECTOR BLOCK WIRING

FIELD OF THE INVENTION

This invention relates to connector block wiring and, in particular, to a method for protecting connector block wiring especially useful in warm, humid environments.

While this invention arises in the context of telephone networks and, specifically building entrance protectors, it is useful in protecting a wide variety of wrapped wire connections.

BACKGROUND OF THE INVENTION

In a telephone network, a network cable from a central office is connected to a building entrance protector (BEP) located at the customer site, where the individual telephone lines are broken out line-by-line. The network cable, which consists of a plurality of tip-ring wire pairs that each represent a telephone line, is typically connected to a connector block that is an integral part of the BEP.

The connector block is typically a non-conductive base plate including a two-dimensional array of conductive connector pins The connectors are secured to the base plate and typically extend through the plate. Each connector typically includes a conductive pin on one side of the plate and a conductive receptacle on the other. Typically noninsulated conductive wires are helically wound on the pins and insulated wires are inserted in the receptacles to make a connection. The receptacle, in an insulation displacement connector, can include sharp edges for stripping off the insulation of an inserted wire. A typical connector is described in U.S. Pat. No. 6,077,112 issued to B. Daoud on Jun. 20, 2000.

A difficulty with such connector blocks in hot, humid climates is corrosion of the connection between the helically wound wire and the pin. To minimize corrosion the wire/pin connections are typically disposed within a marginal cover filled with potting compound. The cured potting compound protects the connections from corrosion, but makes difficult necessary rework (correcting a pin to a different wire) and repair (fixing a defective connection) in the field.

Accordingly there is a need for a method for protecting wire wrapped connections from corrosion which will permit ready access for repair in the field. The method should also permit protection of connections made in the field.

SUMMARY OF THE INVENTION

In accordance with the invention, rather than embedding them collectively in potting compound, wire to pin connections on a connector block are separately coated with protective gel for resisting corrosion. The coating can be effected with high volume gel dispensing equipment in shop environments and by manual gel dispensing in the field, providing significant advantages rework and repair in the field.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It is to be understood that these drawings are for purposes of illustrating the concepts of the invention and are not to scale.

DETAILED DESCRIPTION

Figure 1:
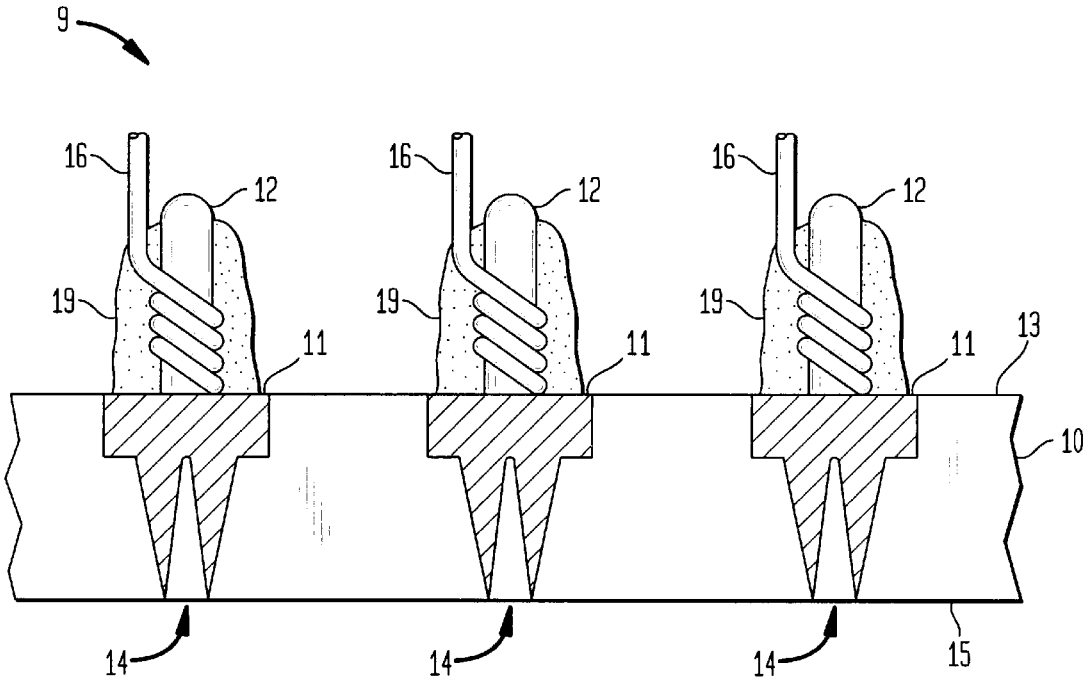
FIG. 1 is a schematic cross section of a portion of a connector array protected in accordance with the invention.

Referring to the drawings, FIG. 1 illustrates in schematic partial cross section, a portion of a connector block 9 comprising a nonconductive base plate 10 including a plurality of connectors 11. Each connector 11 includes a conductive pin 12 on a first side (major surface) 13 of the base plate. The connector 11 typically extends through the base plate 10 and may include a conductive receptacle 14 on a second side 15. Wires 16 are connected to each pin 12 as by helically wrapping around each pin 12 to form an electrical connection. Other wires (not shown) can be inserted into the receptacles 14. The connection regions are protected against corrosion by separate, continuous coatings 19 of protective gel.

The base plate can be polyethylene, and the connectors 11 can be those described in the aforementioned U.S. Pat. No. 6,077,112. The protective gel coatings 19 can be a silicone, epoxy or conformal coating material for single-part or two-part application. Preferably it is SG 1045 Silicone gel, available from Gel Science Corp., Fremont, Calif.

Figure 2:
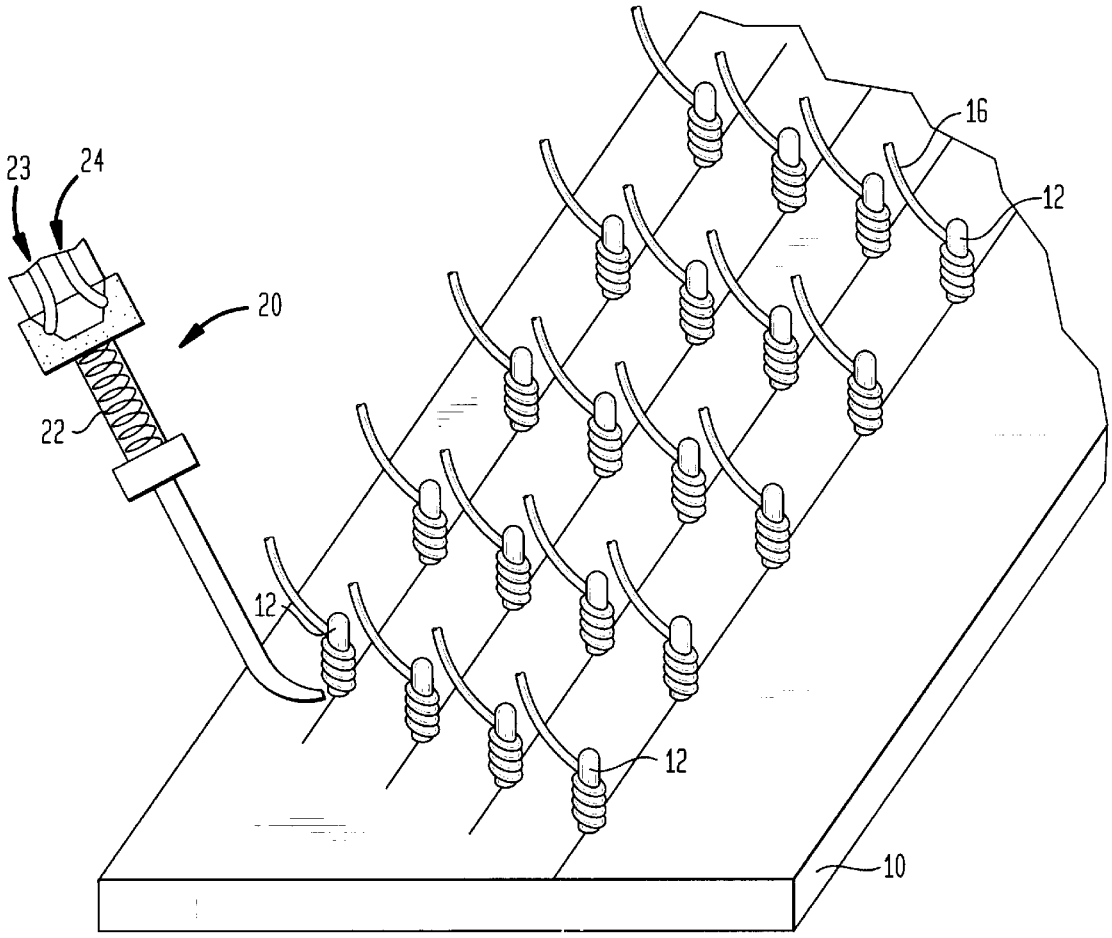
FIG. 2 is a schematic perspective view of a connector array being protected in accordance with the invention.

FIG. 2 is a schematic perspective view illustrating a wire-wound connector pin 12 on a base plate 10 being coated with protective gel using a gel dispenser 20. The preferred dispenser comprises a dispensing nozzle 21 including an internal helical mixing unit 22. A pair of supply hoses 23, 24 can provide gel from one or more pressurized reservoirs (not shown). Such a dispenser is available from the aforementioned Gel Science Corp.

In shop application a high pressure pump is used for each part of the gel. The gel parts are pumped through large diameter lines (in order to reduce the thixotropic properties of the gel) to a static mixer. Flow meters can regulate the amount of material combined. The internal mixing unit 22 of the dispenser will mix the parts and eject the mixed gel through the end of nozzle 21.

The wire/pin connections of a connector block are coated with gel from the dispenser one connection at a time. In the field, the gel coating is easily scraped off a connection providing access for replacing a broken wire or rerouting service. The new connection is easily recoated with protective gel from a portable version of the dispenser.

The advantages of this method of protecting wrapped wire connections are many fold. The gel conforms to complex textures and geometries. It penetrates into crevices and works into cavities. Large surfaces can be covered quickly before the gel begins curing. It uses less material than the conventional potting technique and permits easier rework. And specific connections can be field-installed and repaired.

It is to be understood that the above-described embodiments are illustrative of only a few of the many possible specific embodiments which can represent applications of the principles of the invention. Numerous and varied other arrangements can be readily devised by those skilled in the art without departing from the spirit and scope of the invention.

What is claimed:

1. In a connector block comprising a non-conductive base plate, a plurality of conductive connector pins secured to the base plate in a two dimensional array, and a plurality of conductive wires wrapped around and electrically connected to respective connector pins, the improvement wherein:

each wire to pin connection is separately coated and covered with a protective conformal coating for maintaining the conductive wires in a moisture free environment (resisting corrosion).

2. The improved connector block of claim 1 wherein the conformal coating comprises silicon gel.

3. The improved connector block of claim 1 wherein the wire to pin connections comprise wire-wrapped helical coils.

4. The method of protecting a connector block from corrosion comprising the steps of:

providing a connector block comprising a non-conductive base plate including a plurality of conductive connector pins secured to the base plate and a plurality of wires wrapped around and electrically connected to respective connector pins; and separately coating and covering wire on each pin with a protective conformal coating for maintaining the wires in a moisture free environment.

5. The method of claim 4 wherein the conformal coating comprises silicone gel.

6. The method of claim 4 wherein each wire to pin connection comprises a wire-wrapped helical coil.

7. The method of repairing or reworking a connector block in the field comprising:

installing a connector block comprising an array of connector pins around which are wrapped respective wires, each wire to pin connection separately coated and covered with a first protective conformal coating;

selectively removing the protective coating from wire to pin connection to be reworked or repaired;

repairing or reworking the exposed connections; and separately coating and covering the repaired or reworked connections with a second conformal coating for maintaining the wires in a moisture free environment.

8. The method of claim 7 wherein the second conformal coating comprises silicone gel.

9. The method of claim 7 wherein the first conformal coating comprises silicone gel.

10. The method of claim 7 wherein each wire to pin connection comprises a wire wrapped helical coil.

* * * * *